US007325650B2

(12) United States Patent
Horigome et al.

(10) Patent No.: US 7,325,650 B2
(45) Date of Patent: Feb. 5, 2008

(54) SPEAKER

(75) Inventors: Minoru Horigome, Yamagata (JP); Hiroshi Sato, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 0 days.

(21) Appl. No.: 11/362,500

(22) Filed: Feb. 27, 2006

(65) Prior Publication Data

US 2006/0191741 A1 Aug. 31, 2006

(30) Foreign Application Priority Data

Feb. 25, 2005 (JP) ..... 2005-050037

(51) Int. Cl.
*H04R 7/26* (2006.01)
*H04R 9/06* (2006.01)
*H04R 11/02* (2006.01)

(52) U.S. Cl. ..... 181/166; 381/405

(58) Field of Classification Search ..... 181/166, 181/171, 172; 381/398, 405
See application file for complete search history.

(56) References Cited

U.S. PATENT DOCUMENTS 1,836,076 A * 12/1931 Kingsford ..... 381/405
1,879,042 A * 9/1932 Benecke ..... 181/171
1,909,275 A * 5/1933 Holland ..... 381/405
1,974,770 A * 9/1934 Enghotm ..... 381/405
1,987,445 A * 1/1935 Kalin ..... 381/405
1,990,858 A * 2/1935 Dijksterhuis ..... 381/405
2,031,775 A * 2/1936 Hinchen ..... 381/405
2,038,401 A * 4/1936 Wunderlich ..... 381/405
2,039,856 A * 5/1936 Taber ..... 381/405
2,070,977 A * 2/1937 Quinnell ..... 381/189
2,105,934 A * 1/1938 Stevens ..... 381/405
2,141,949 A * 12/1938 Carbonneau ..... 381/405
3,496,307 A * 2/1970 Hiromi Sotome ..... 381/420
3,578,104 A * 5/1971 Sotome ..... 181/164
4,034,165 A * 7/1977 Haeder ..... 381/392
4,508,941 A * 4/1985 Wiggins ..... 381/405
4,817,165 A * 3/1989 Amalaha ..... 381/425
5,123,053 A * 6/1992 House ..... 381/405
5,619,019 A * 4/1997 Yoshimura et al. ..... 181/166
5,822,444 A * 10/1998 Oizumi et al. ..... 381/405
6,343,128 B1 * 1/2002 Coffin ..... 381/186
2001/0043713 A1 * 11/2001 Tokusho et al. ..... 381/398
2004/0037446 A1 * 2/2004 Hasegawa et al. ..... 381/405

FOREIGN PATENT DOCUMENTS

JP 52063321 A * 5/1977
JP 8-242497 9/1996

* cited by examiner

*Primary Examiner*—Edgardo San Martin
(74) *Attorney, Agent, or Firm*—Arent Fox LLP

(57) ABSTRACT

A speaker according to the present invention is equipped with a diaphragm having a central portion of a dome shape and an edge portion formed on an outer periphery thereof. Further, the speaker has also a frame attached with an outermost fringe of the edge portion and a damper member provided inside the central portion to support the central portion. The damper member supports an inner side surface of a voice coil bobbin also, so that a voice coil can be adequately positioned within a magnetic gap.

4 Claims, 3 Drawing Sheets

SPEAKER

BACKGROUND OF THE INVENTION

1. Field of the Invention

The present invention relates to a speaker.

The present application claims priority from Japanese Patent Application No. 2005-50037, the disclosure of which is incorporated herein by reference, 2. Description of the Prior Art A speaker provided with a dome-shaped diaphragm has merits that the size of speaker can be formed in a smaller diameter, and also that a good directivity is caused as known well. Accordingly, this type of speaker has been widely used as portable and personal sound sources.

It is well known that, in the speaker provided with the diaphragm having a dome shape at a part thereof, there occurs a disorder of frequency characteristics in which a sound pressure level of intermediate tone range becomes depressed by a reverse resonance between an edge portion and a central portion having a dome shape in the case where the edge portion is provided at an outer periphery of the diaphragm, and also an outermost fringe of the edge portion is attached on a frame in a structure of the diaphragm. In order to avoid such a disadvantage, there has been adopted a diaphragm called a "soft dome" which uses a material having a flexibility as one of characteristics of the material of the diaphragm. According to the speaker of such a "soft dome" type, the disorder of frequency characteristics in the intermediate tone range is restrained by designing not only to suppress a peak thereof as much as possible but also to keep a proper tone in an audible sound range through making use of vibrations at the edge portion.

The diaphragm of the "soft dome" type is usually formed by impregnating resin into cloth such as cotton, silk or synthetic fiber and then heating it, or is formed with foaming resin. Moreover, Japanese Unexamined Patent Application Publication No. Hei 08-242497 discloses a diaphragm formed by an olefinic elastomer denaturation nylon resin film.

FIG. 1 is an explanatory view showing a conventional speaker J1 provided with a diaphragm J2 having a dome-shaped portion J2*a* and an edge portion J2*b* formed on an outer periphery thereof, which is disclosed in Japanese Unexamined Patent Application Publication No. Hei 08-242497. An outermost fringe of the edge portion J2*b* is attached on a frame J3. The dome-shaped portion J2*a* is fixed on an upper portion of an outer periphery surface of a voice coil bobbin J4, and a voice coil J5 is wound up around a lower portion of an outer periphery surface of the voice coil bobbin J4. Further, a magnetic circuit is formed by an upper plate J6, a magnet J7 and a yoke J8. The voice coil J5 is located in a magnetic gap Jg formed between an inside surface of the upper plate J6 and an outside surface of a center pole portion J8*a* in the yoke J8.

A positioning accuracy of the voice coil J5 in the above-mentioned conventional speaker J1 is just dependent on support as caused by fixing the edge portion J2*b* on frame J3 and also a shape retaining function of the diaphragm J2 itself, so that it is very difficult to hold the voice coil J5 at an appropriate position in the magnetic gap Jg in an up-and-down direction in the case where the "soft dome" type of diaphragm having a low shape-retaining function is used, especially in which the edge portion J2*b* is widely formed, Moreover, the resonance frequency of the "soft dome" type of diaphragm J2 provided with the edge portion J2*b* is adjusted by the size of the edge portion J2*b*, and thus it is more difficult to hold the voice coil J5 at the appropriate position when the edge portion J2*b* is widely formed.

Especially, in the case where magnetic fluid is included in the magnetic gap Jg, there arises a problem that the voice coil J5 is not located at the appropriate position in the magnetic gap Jg due to a relation of a specific gravity of the magnetic fluid with those of both the voice coil bobbin J4 and the voice coil J5.

On the other hand, although it is possible to improve the shape retaining function of the diaphragm J2 itself by changing the materials thereof as described in the prior art mentioned above, a selection range of the materials is limited into a small range for doing so. In other words, the freedom degree of design in the frequency characteristic caused by any diaphragm materials is limited, Accordingly, extremely difficult is the design not only of desired frequency characteristics but also of sufficient shape retaining functions of the diaphragm J2 itself to be compatible with each other. In addition, a cost-up for manufacturing the diaphragm J2 may be unavoidable.

Followings are objects of the present invention for resolving the above-mentioned problems about the diaphragm of the soft dome type, particularly, provided with the edge portion:

① Making it possible to appropriately position the voice coil;

② Making it possible to adjust the frequency of the diaphragm by using a size of edge portion; and ③ Heightening the freedom degree of the characteristics design based on a material selection and making it possible to avoid a cost-up in manufacturing the diaphragm.

SUMMARY OF THE INVENTION

To achieve the objects as mentioned above, the speaker of the present invention comprises at least the following features.

According to an aspect of the present invention, there is provided a speaker comprising a diaphragm having a central portion with a dome shape and an edge portion formed on an outer periphery thereof, a frame, with which an outermost fringe of the edge portion is attached, and a damper member provided inside the central portion for supporting the central portion.

BRIEF DESCRIPTION OF THE DRAWINGS

These and other objects and advantages of the present invention will become clearly understood from the following description with reference to the accompanying drawings, wherein.

DETAILED DESCRIPTION OF THE PREFERRED EMBODIMENTS

Figure 1:
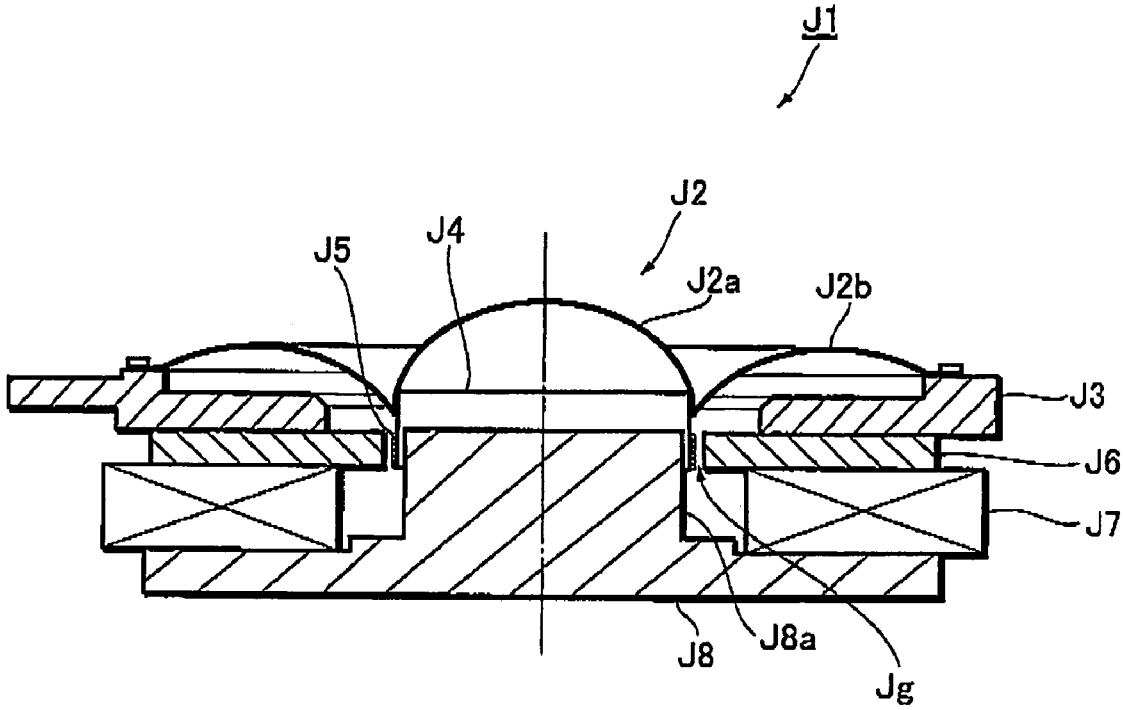
FIG.1 PRIOR ART
FIG. 1 is a sectional view of a conventional speaker according to a prior art.
Figure 2A:
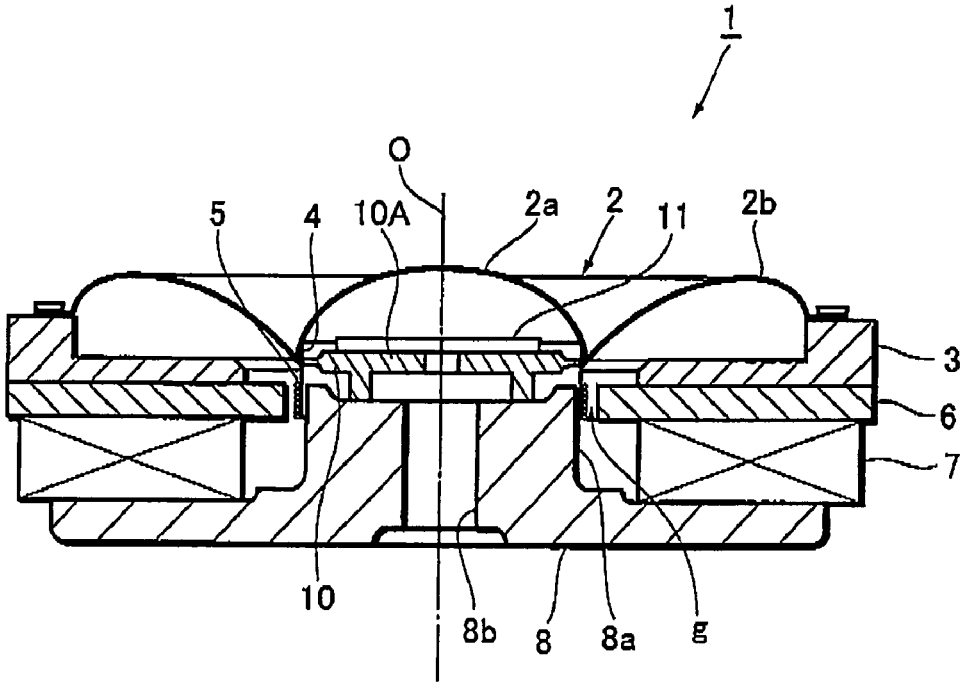
FIG. 2A is a sectional view of a speaker according to an embodiment of the present invention.
Figure 2B:
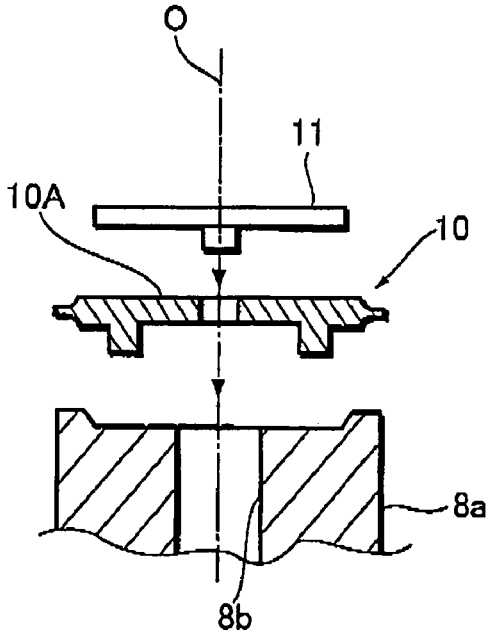
FIG. 2B is a disassembled sectional view of a part of the speaker as shown in FIG. 2A.

An embodiment of the present invention will be described hereinafter with reference to the accompanying drawings. FIG. 2A is a sectional view of a speaker according to an embodiment of the present invention, and FIG. 2B is a disassembled sectional view of a part thereof.

As shown in FIG. 2A, a speaker 1 of the present invention has a diaphragm 2 and a frame 3. The diaphragm 2 comprises a central portion 2*a* having a dome-shaped configuration and an edge portion 2*b* formed on an outer periphery of the central portion 2*a*. An outermost fringe of the edge portion 2*b* is attached on the frame 3. An inner surface of the central portion 2*a* is fixed on an upper and outer periphery surface of a voice coil bobbin 4, and also a voice coil 5 is wound around a lower and outer periphery surface of the voice coil bobbin 4.

Further, a magnetic circuit is formed by an upper plate 6, a magnet 7 and a yoke 8. The voice coil 5 is located in a magnetic gap "g" formed between an inside surface of the upper plate 6 and an outside surface of a center pole portion 8*a* in the yoke 8.

The speaker 1 is provided with a damper member 10 for supporting the central portion 2*a* inside the central portion 2*a*. The damper member 10 supports the inner side surface of the voice coil bobbin 4 also for positioning the voice coil 5 at an appropriate position in the magnetic gap "g", and thus is preferably formed by such an elastic element as a rubber.

More specifically, the damper member 10 having a ring shape, a cylindrical supporting portion 10A of which has the same center line "0" as that of the center pole portion 8*a*, is located on a top portion of the center pole portion 8*a*, along an outer periphery surface of which the magnetic gap "g" is formed. Also, an outermost surface of the damper member 10 is fixed on the inner side surface of the voice coil bobbin 4.

As described above, according to the speaker 1 of the present embodiment of the present invention, having the damper member 10 for supporting the central portion 2*a* of the diaphragm 2 from inside, the central portion 2*a* can be easily positioned at the appropriate position even in the case of the soft dome type diaphragm where a shape retaining function of the diaphragm itself is usually weak.

Since the voice coil 5 is located at an appropriate position in the magnetic gap "g" by supporting the inner side surface of the voice coil bobbin 4 with the damper member 10, a balance of variation amplitude in an up-and-down direction for the voice coil 5 can be adequately kept, so that vibration without distortion can be gained. Even if magnetic fluid is filled in the magnetic gap "g", the position of the voice coil 5 can be adequately kept irrespective of specific gravity of the magnetic fluid, the voice coil 5, and the like, according to the speaker of the present invention.

Furthermore, since the damper member 10 having the ring shape is located so as to allow a center of the damper member 10 to coincide with the center line "0" of the center pole portion 8*a*, the voice coil bobbin 4 (that is, the voice coil 5 also wound around the outer periphery thereof) or the central portion 2*a* of the diaphragm 2 fixed thereon can be constantly positioned along the center line "0" of the center pole portion 8*a* irrespective of the size of the edge portion 2*b*.

Thereby, even though the edge portion 2*b* is formed with a large width, a displacement of the center of each member during an actual operation time of the speaker 1 can be avoided, so that an adequate vibration of the diaphragm can be gained since the voice coil 5 is hold at an adequate position. In such a way, more satisfaction of customers can be attained through an improvement of a sound quality.

A support structure of the damper member 10 will be explained in more details by referring to FIG. 2B. A cylindrical opening 8*b*, which is concentric with the center line "0", is formed at a central portion of the center pole portion 8*a*, and the supporting member 10A of the damper member 10 is mounted on a top of the center pole portion 8*a* near the cylindrical opening 8*b*.

An acoustic absorption material 11 may be provided for decreasing standing waves in a space formed between the damper member 10 and the central portion 2*a* of the diaphragm 2 by devising a top configuration of the damper member 10. Thereby, better frequency characteristics can be gained.

Figure 3:
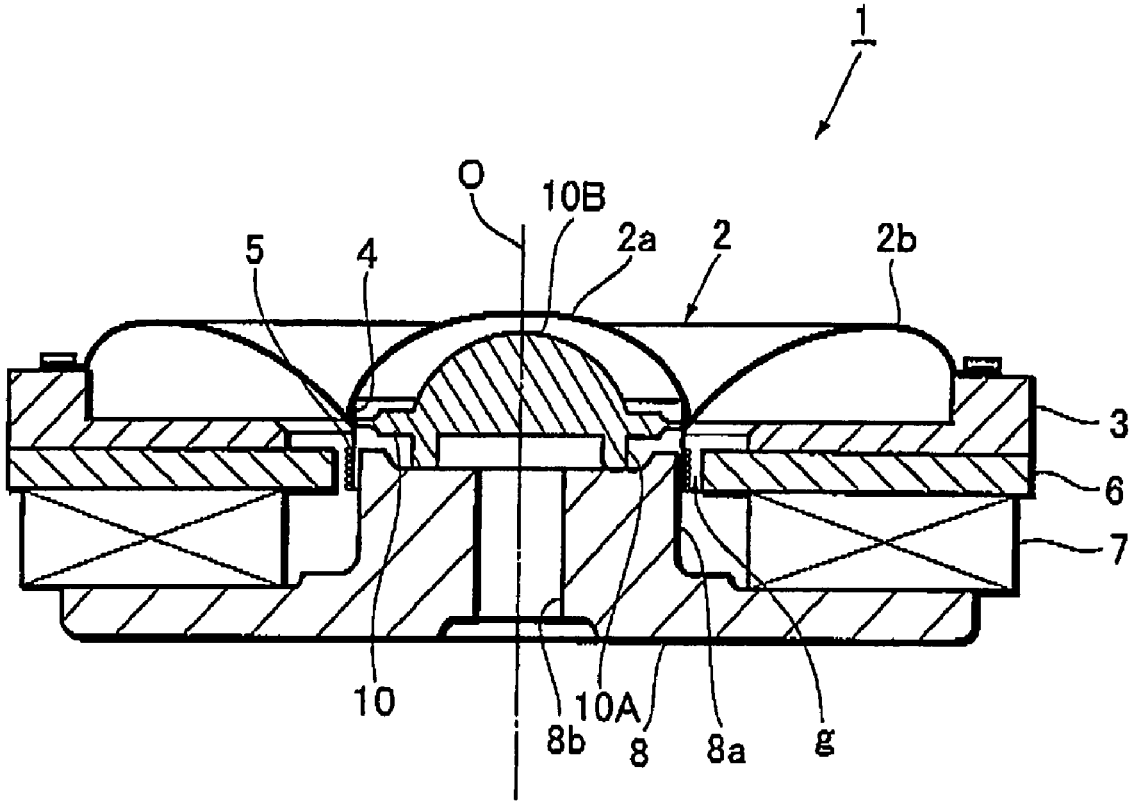
FIG. 3 is a sectional view of a speaker according to another embodiment of the present invention.

In another embodiment of the present invention as shown in FIG. 3, wherein the same numerals as those of FIG. 2A are used for abbreviating the same explanation, a protrusion portion 10B may be provided at a top of the damper member 10, so that a stopper function for resisting against an external force at the central portion 2*a* of the diaphragm 2, which occurs when pushed by a human finger, can be added. Alternatively, the same stopper function as mentioned above can be attained through just raising the top of the damper member 10 even though it is formed without the protrusion portion 10B. Thereby, a deformation of the central portion 2*a* in the diaphragm 2 can be avoided to prevent the speaker from being broken when it is exhibited in a retail store or shop.

According to the speaker of the present invention, the voice coil can be easily and adequately positioned even in the speaker provided with the edge portion and the "soft dome" type of diaphragm. Since the central portion of the diaphragm or the voice coil can be positioned irrespective of the size of the edge portion, the desired frequency characteristic can be attained through utilizing the size of the edge portion, In addition, since the present invention is not related to any material of diaphragm, the frequency characteristic can be freely improved due to a selection of material if desired, however, on the other hand a low cost of diaphragm can be gained, if desired, since it is not needed to use expensive material in the configuration of the present invention.

While there has been described what are at present considered to be preferred embodiments of the present invention, it will be understood that various modifications may be made thereto, and it is intended that the appended claims cover all such modifications as fall within the true spirit and scope of the present invention.

What is claimed is:

1. A speaker comprising:

a diaphragm having a central portion with a dome shape and an edge portion formed on an outer periphery thereof;

a frame, with which an outermost fringe of said edge portion is attached;

a voice coil bobbin, an upper and outer periphery surface thereof being fixed on an inner surface of said central portion;

a voice coil wound around a lower and outer periphery surface of said voice coil bobbin;

a center pole portion, in which a magnetic gap is formed along an outer periphery surface thereof, said center pole portion having a top portion; and a damper member provided inside said central portion, covering substantially all of the top portion of said center pole portion and supporting an inner side surface of said voice coil bobbin to position said voice coil at an appropriate position in said magnetic gap.

2. The speaker according to claim 1, further comprising: an acoustic absorption material provided in a space between said damper member and said central portion of diaphragm to decrease standing waves.

3. The speaker according to claim 1, further comprising: a protrusion portion provided at a top of said damper member to add a stopper function against external forces for preventing a deformation or a distortion of said central portion from occurring thereby.

4. The speaker according to claim 1, wherein said damper member is rubber.

* * * * *